US009463907B2

(12) United States Patent
Barlow et al.

(10) Patent No.: US 9,463,907 B2
(45) Date of Patent: Oct. 11, 2016

(54) CREAM DISPENSER

(75) Inventors: Louise Margaret Barlow, Hull (GB); Geoffrey Robert Hammond, Hull (GB); Jonathan Mark Law, Hull (GB)

(73) Assignee: RECKITT & COLMAN (OVERSEAS) LIMITED, Berkshire (GB)

( * ) Notice: Subject to any disclaimer, the term of this patent is extended or adjusted under 35 U.S.C. 154(b) by 0 days.

(21) Appl. No.: 13/983,527

(22) PCT Filed: Feb. 6, 2012

(86) PCT No.: PCT/GB2012/050247

§ 371 (c)(1),
(2), (4) Date: Oct. 1, 2013

(87) PCT Pub. No.: WO2012/104660

PCT Pub. Date: Aug. 9, 2012

(65) Prior Publication Data

US 2014/0319173 A1 Oct. 30, 2014

(30) Foreign Application Priority Data

Feb. 4, 2011 (GB) ..... 1101939.5

(51) Int. Cl.
*B65D 35/28* (2006.01)
*A45D 34/00* (2006.01)
(Continued)

(52) U.S. Cl.
CPC ..... *B65D 35/28* (2013.01); *A45D 34/00* (2013.01); *A45D 37/00* (2013.01); *A45D 40/0087* (2013.01); *A45D 40/22* (2013.01); *A45D 2200/054* (2013.01)

(58) Field of Classification Search
CPC ..... A45D 34/00; A45D 37/00; A45D 40/22; A45D 2200/054; A45D 40/0087; B05D 35/28
USPC ..... 222/103, 206; 401/133
See application file for complete search history.

(56) References Cited

U.S. PATENT DOCUMENTS 2,076,048 A * 4/1937 Seelman ..... 222/103
2,357,544 A * 9/1944 Prance ..... 222/96
(Continued)

FOREIGN PATENT DOCUMENTS

FR 1524378 A 5/1968
WO 2007072040 A1 6/2007

OTHER PUBLICATIONS

International Search Report mailed Apr. 23, 2012 for priority application PCT/GB2012/050247.
(Continued)

*Primary Examiner* — Kevin P Shaver
*Assistant Examiner* — Robert Nichols, II
(74) *Attorney, Agent, or Firm* — Troutman Sanders LLP; Ryan A. Schneider; Chris N. Davis

(57) ABSTRACT

The present invention is directed to a combination of a deformable package (20) containing a cream product; and a tool (10) for dispensing the cream product from the deformable package (20) comprising a first member (12) which supports the deformable package (20), and a second member (14) connected to the first member (12) by a hinge (40), wherein the tool (10) is arranged so that, in use, when a user pushes the first and second members (12), (14) towards one another, the deformable package (20) is squeezed between the first and second members (12), (14) to dispense the cream product from the package (20).

11 Claims, 1 Drawing Sheet

Figure 1:
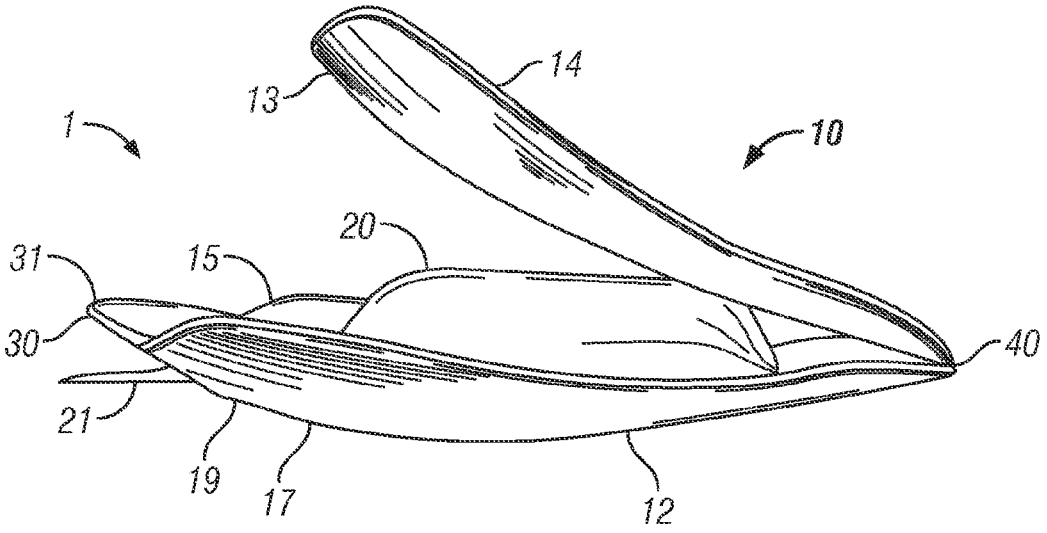

(51) Int. Cl.

| | |
|---|---|
| ***A45D 37/00*** | (2006.01) |
| ***A45D 40/00*** | (2006.01) |
| ***A45D 40/22*** | (2006.01) |

(56) References Cited

U.S. PATENT DOCUMENTS

| | | | | |
|---|---|---|---|---|
| 2,674,392 | A * | 4/1954 | Kunz | 222/80 |
| 2,903,161 | A * | 9/1959 | Stahmer | 222/81 |
| 3,281,016 | A | 10/1966 | Thompson | |
| 4,172,536 | A * | 10/1979 | Holt | 222/103 |
| 4,432,768 | A * | 2/1984 | Brown | A01K 5/0216 604/200 |
| 5,332,194 | A * | 7/1994 | Austin et al. | 251/345 |
| 5,683,013 | A * | 11/1997 | Morrison | 222/103 |
| 5,743,434 | A | 4/1998 | Light | |
| 6,234,353 | B1 | 5/2001 | Light | |
| 6,889,870 | B2 * | 5/2005 | De Laforcade | 222/1 |
| 7,077,292 | B2 * | 7/2006 | Turano | 222/103 |
| 2003/0192909 | A1 * | 10/2003 | Maskell | 222/103 |
| 2005/0047846 | A1 | 3/2005 | Narang et al. | |
| 2006/0043108 | A1 | 3/2006 | Burrell | |
| 2007/0138204 | A1 | 6/2007 | Chen et al. | |

OTHER PUBLICATIONS

International Preliminary Report on Patentability mailed Aug. 15, 2013 for priority application PCT/GB2012/050247.

* cited by examiner

CREAM DISPENSER

CROSS-REFERENCE TO RELATED APPLICATIONS

This application is a US National Stage of International Application No. PCT/GB2012/050247, filed 6 Feb. 2012, which claims the benefit of GB 1101939.5, filed 4 Feb. 2011, both herein fully incorporated by reference.

The present invention relates to a dispenser for a cream, such as a depilatory cream.

It is common for depilatory cream to be supplied in a tube containing enough cream for a number of applications. Alternatively, the cream may be provided in a single use sachet. In some cases, in order to facilitate the application and removal of the cream, a separate spatula is provided.

An example of such a depilatory cream product is the VEET® Rasera™ Bladeless™ Kit. The kit comprises a canister of depilatory cream and a bladeless tool for scraping the cream from the skin. The user applies the cream to their hair with their fingers and removes the cream with the bladeless tool after a set period of time. The bladeless tool comprises a handle and a head, the head having a number of flexible rubber strips that conform to the shape of the users body to facilitate removal of the cream.

The present invention is directed at providing a more convenient dispensing package.

According to the present invention there is provided a combination of: a deformable package containing a cream product; and a tool for dispensing the cream product from the deformable package comprising a first member which supports the deformable package, and a second member connected to the first member by a hinge, wherein the tool is arranged so that, in use, when a user pushes the first and second members towards one another, the deformable package is squeezed between the first and second members to dispense the cream product from the package.

Preferably, the cream product is a depilatory cream product.

The present invention provides a convenient, self contained way to dispense depilatory cream so that the user does not have to touch the cream. The tool may be re-usable with packages of the same or different sizes or may be disposable along with the empty package after use.

Preferably the first member comprises a concave portion and the deformable package is received in the concave portion. This is advantageous as it provides a secure recessed support for the package.

In a preferred example the second member comprises a convex portion which generally conforms to the concave portion of the first member. The conformity of the first and second members is beneficial as it helps to ensure that the majority of the depilatory cream is squeezed from the package as the members are pushed together.

In a further example, the first member advantageously comprises a product application surface and the tool is arranged so that, in use, the depilatory cream product is dispensed onto the product application surface. This provides the user with a convenient, self contained way to dispense and apply the depilatory cream without having to touch the cream. Preferably the product application surface is convex for ease of use.

Advantageously the tool further comprises a product removal edge for removing the depilatory cream from the skin of a user. Preferably the product removal edge is on an insert provided on the tool, wherein the insert comprises a material of greater flexibility than that of either the first and/or second member for better conformity to the contours of the user's body.

Suitably the first and second members are arranged to clip together to form a spatula tool enabling the user to spread and remove the cream with greater ease.

Figure 2:
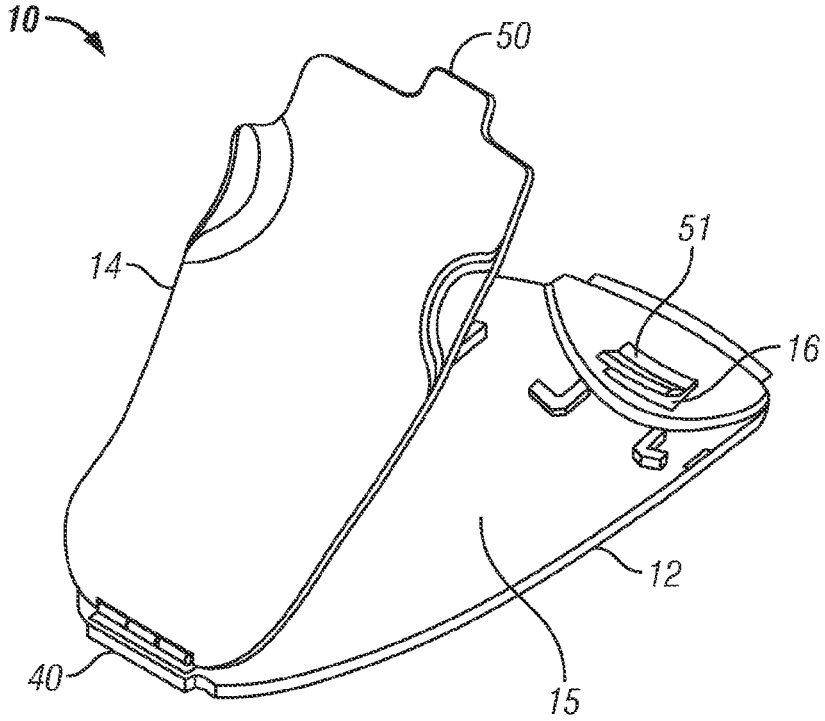

An example of the invention will now be given with reference to the following Figures in which:

FIG. 1 is a side view of a depilatory cream dispenser according to the present invention; and FIG. 2 is a perspective view of an alternative embodiment of the tool of FIG. 1.

FIG. 1 shows a depilatory cream dispenser 1 consisting of a sachet 20 and a tool 10. The tool 10 comprises a support member 12 for supporting the sachet 20 and a pusher member 14. The support and pusher members 12, 14 are attached to one another by a hinge 40 which is located between peripheral edges of the support and pusher members. The tool 10 further comprises an insert 30 attached to the support member 12, the insert 30 defining a product removal edge 31.

The support member 12 comprises a concave portion 15 which is arranged to receive the sachet 20 and a convex portion 17 which defines a product application surface 19. As shown, the pusher member 14 comprises a convex portion 13 which generally conforms to the concave portion 15 of the support member 12. The support member 12 further comprises a slot 16 (see FIG. 2) which provides access between the concave portion 15 and the product application surface 19.

The sachet 20 is held in place on the support member 12 by a double sided sticker (not shown). The sachet 20 has a tab 21 that is attached to the sachet 20 at an opening (not shown). The tab 21 of the sachet 20 passes through the slot 16 so that the opening is located adjacent the product application surface 19. The opening may be notched for easy tear or may have a line of weakness for easy tear.

In use, the user removes the tab 21 from the sachet 20 to open the sachet. The user then pushes the support and pusher members 12, 14 towards one another so that the sachet 20 is squeezed between the support and pusher members to dispense cream onto the product application surface 19. The user may then spread the cream onto their skin using the product application surface 19 and remove the cream, after a set period of time, with the product removal edge 31.

As shown in FIG. 2, in an alternative embodiment the support and pusher members 12, 14 may each comprise cooperating formations 50, 51 that clip together when the support and pusher members 12, 14 are pushed together.

The sachet 20 will generally be fabricated from a laminate material. However, the sachet 20 may be substituted with any deformable container such as a plastic bottle, or a thermoformed blister pack.

The support and pusher members 12, 14 will generally be fabricated from a plastic material such as polypropylene.

The insert 30 is fabricated from a flexible rubber material such as thermoplastic elastomer. In an alternative embodiment the product removal edge 31 may be integral with one or other of the support or pusher members 12, 14.

The hinge 40 may be a live hinge which holds the support and pusher members 12, 14 resiliently apart in the absence of applied pressure from the user.

The support member 12 may be arranged to receive sachets of varying sizes depending on which area of the body the user wishes to depilate.

The invention claimed is:

1. A dispenser combination comprising:

a deformable package containing a cream product; and a tool for dispensing at least a portion of the cream product from the deformable package, the tool comprising:

a first member consisting of a concave portion in which the deformable package is received;

a second member consisting of a convex portion cooperatively shaped to conform to the concave portion of the first member;

a hinge connecting the first member to the second member;

a product application surface; and a product removal edge;

wherein the first and second members are arranged to clip together to form a spatula tool;

wherein the tool is arranged so that, in use, when a user pushes the first and second members towards one another, the deformable package is squeezed between the first and second members to dispense the cream product from the package, and wherein the tool is further arranged so that, in use, the cream product is dispensed onto the product application surface.

2. The dispenser combination as claimed in claim 1, wherein the product application surface is convex.

3. The dispenser combination as claimed in claim 1, wherein the product removal edge is on an insert provided on the tool; and wherein the insert comprises a material of greater flexibility than that of either the first and second member.

4. The dispenser combination as claimed in claim 1, wherein the cream product is a depilatory cream product.

5. The dispenser combination as claimed in claim 1, wherein the first member further comprises a first formation;

wherein the second member further comprises a second formation; and wherein the first and second formations define cooperating formations that clip together when the first member and the second member are pushed together.

6. The dispenser combination as claimed in claim 1, wherein the deformable package comprises a tab;

wherein the first member further comprises a slot; and wherein the tab of deformable package passes through the slot of the first member so that upon removal of the tab, an opening of the deformable package is located adjacent the product application surface.

7. The dispenser combination as claimed in claim 6, wherein the tool is arranged so that, in use, a user removes the tab from the deformable package to open the deformable package.

8. A dispenser combination comprising:

a deformable package containing a cream product, the deformable package having a tab; and a tool for dispensing at least a portion of the cream product from the deformable package, the tool comprising:

a first member comprising:

a concave portion that is arranged to receive the deformable package and a convex portion that defines a product application surface;

a slot that provides access between the concave portion of the first member and the product application surface; and an insert;

a second member comprising a convex portion that generally conforms to the concave portion of the first member; and a hinge located between peripheral edges of the first and second members and connecting the first member to the second member;

wherein the insert defines a product removal edge;

wherein the tab of the deformable package passes through the slot of the first member so that upon removal of the tab, an opening of the deformable package is located adjacent the product application surface; and wherein the tool is arranged so that, in use, a user removes the tab from the deformable package to open the deformable package, and then pushes the first and second members towards one another, squeezing the deformable package between the first and second members to dispense the cream product from the deformable package onto the product application surface.

9. The dispenser combination as claimed in claim 8, wherein the first member further comprises a first formation;

wherein the second member further comprises a second formation; and wherein the first and second formations define cooperating formations that clip together when the first member and the second member are pushed together.

10. The dispenser combination as claimed in claim 8, wherein the first and second members are arranged to clip together to form a spatula tool.

11. The dispenser combination as claimed in claim 8, wherein the cream product is a depilatory cream product.

* * * * *